US010704223B2

(12) United States Patent
Aoki et al.

(10) Patent No.: US 10,704,223 B2
(45) Date of Patent: Jul. 7, 2020

(54) WORK VEHICLE

(71) Applicant: Hitachi Construction Machinery Co., Ltd., Bunkyo-ku, Tokyo (JP)

(72) Inventors: Isamu Aoki, Tsuchiura (JP); Koji Hyodo, Tsuchiura (JP); Tetsuji Tanaka, Tsuchiura (JP); Keigo Kikuchi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 157 days.

(21) Appl. No.: 15/361,267

(22) Filed: Nov. 25, 2016

(65) Prior Publication Data

US 2017/0073923 A1 Mar. 16, 2017

Related U.S. Application Data

(63) Continuation of application No. 14/360,963, filed as application No. PCT/JP2012/075986 on Oct. 5, 2012, now abandoned.

(30) Foreign Application Priority Data

Dec. 19, 2011 (JP) ..... 2011-277310

(51) Int. Cl.
*E02F 3/43* (2006.01)
*E02F 9/22* (2006.01)
(Continued)

(52) U.S. Cl.
CPC ..... *E02F 3/431* (2013.01); *E02F 9/2079* (2013.01); *E02F 9/2207* (2013.01);
(Continued)

(58) Field of Classification Search
CPC ..... E02F 3/431; E02F 9/265; E02F 9/2217; E02F 9/2079
(Continued)

(56) References Cited

U.S. PATENT DOCUMENTS 5,147,172 A 9/1992 Hosseini
7,344,351 B2 3/2008 Rokusek et al.
(Continued)

FOREIGN PATENT DOCUMENTS

JP 5-209422 A 8/1993
JP 2011-1712 A 1/2011
(Continued)

OTHER PUBLICATIONS

Corresponding International Search Report dated Jan. 15, 2013, with English Translation (three (3) pages).

*Primary Examiner* — Khoi H Tran
*Assistant Examiner* — Rodney P King
(74) *Attorney, Agent, or Firm* — Crowell & Moring LLP

(57) ABSTRACT

Provided is a work vehicle which is capable of appropriately setting the height of a work tool as a control threshold value for a ride control device or an automatic transmission control device, and which is excellent in operability, travel stability, and work efficiency. A value detected by an angle sensor (39) when a signal import switch (46) is operated by an operator is stored in a height position storage unit (35*b*) of a main controller (35) as height position information about a bucket (13) for excavation work. In the height position storage unit (35*b*), the height position of the bucket (13) for hauling work and the height position of the bucket (13) for loading work are stored in advance as offset values from the height position information about the bucket (13) for excavation work. In this way, the ride control device or the automatic transmission control device can be appropriately controlled regardless of the preference or habit of the operator.

3 Claims, 12 Drawing Sheets

(51) Int. Cl.
*E02F 9/26* (2006.01)
*E02F 9/20* (2006.01)

(52) U.S. Cl.
CPC ..... *E02F 9/2217* (2013.01); *E02F 9/2253* (2013.01); *E02F 9/265* (2013.01)

(58) Field of Classification Search
USPC ..... 701/50
See application file for complete search history.

(56) References Cited

U.S. PATENT DOCUMENTS

| | | | | |
|---|---|---|---|---|
| 2001/0044685 | A1 | 11/2001 | Schubert | |
| 2010/0161184 | A1* | 6/2010 | Marathe | E02F 9/2217 701/50 |
| 2012/0010790 | A1 | 1/2012 | Kanayama et al. | |
| 2012/0155999 | A1 | 6/2012 | Murimoto et al. | |
| 2012/0296531 | A1 | 11/2012 | Hyodo et al. | |
| 2013/0103247 | A1 | 4/2013 | Ogawa et al. | |
| 2017/0073923 | A1* | 3/2017 | Aoki | E02F 9/2079 |

FOREIGN PATENT DOCUMENTS

| | | | |
|---|---|---|---|
| JP | 2011-56644 | A | 3/2011 |
| WO | WO 2011/074583 | A1 | 6/2011 |

* cited by examiner

FIG. 4

| SET ITEM OF HEIGHT POSITION | SET VALUE OF HEIGHT POSITION | FLAG | OPEN/CLOSED STATE OF CONTROL VALVE |
|---|---|---|---|
| UPPER LIMIT POSITION | H4<br>H1+H3 | ✓ | CLOSED |
| LOADING POSITION | H3 | ✓ | OPEN |
| HAULING POSITION<br>EXCAVATION POSITION<br>LOWER LIMIT POSITION | H1+H2<br>H2<br>H1<br>H0 | ✓ | CLOSED |

WORK VEHICLE

CROSS REFERENCE TO RELATED APPLICATIONS

This application is a continuation of U.S. application Ser. No. 14/360,963, which entered the PCT U.S. National Phase on May 28, 2014, as a 371 of International PCT Application No. PCT/JP2012/075986, filed Oct. 5, 2012, which claims priority from Japanese Patent Application No. 2011-277310, filed Dec. 19, 2011, the disclosures of which are expressly incorporated by reference herein.

TECHNICAL FIELD

The present invention relates to a work vehicle such as a wheel loader, and particularly relates to a work vehicle provided with a ride control device or a transmission control device in which the height position of a work tool such as a bucket is used as a control parameter.

BACKGROUND ART

In the background art, there has been known a work vehicle provided with a travel vibration suppression device which is called a ride control device. The ride control device is a device in which a hydraulic pressure accumulator is connected through a control valve to a lift cylinder hydraulic circuit which supplies hydraulic oil to a lift cylinder for driving a work tool. In the ride control device, the hydraulic oil is allowed to circulate between the lift cylinder and the hydraulic pressure accumulator when the control valve is opened. The fluctuation of bottom pressure generated in the lift cylinder due to the vertical motion of the work vehicle which is travelling can be absorbed to the hydraulic pressure accumulator so as to reduce the impact acting on the vehicle body. The control valve is fundamentally changed over by manual operation performed on a ride control switch by an operator. In the background art, in order to automatically change over the control valve in accordance with the operation situation of the work vehicle, there has been also known a technique in which the control valve is changed over from a closed state to an open state automatically when the vehicle speed reaches a predetermined set speed or higher (for example, see Patent Literature 1).

However, in the configuration in which the control valve is opened and closed automatically in accordance with only the vehicle speed, the control valve may be opened and closed in a state which is not intended by the operator. As a result, a sense of discomfort or a sense of insecurity in operation may be easily given to the operator. For example, description will be made by way of example in the case where in which a bucket is provided as a work tool for performing excavation work, hauling work and loading work onto a dump truck or the like. When the vehicle speed is higher than a set speed, the control valve is automatically changed over from the closed state to the open state in spite of the excavation work. Thus, the force acting on the bucket escapes to the hydraulic pressure accumulator through the lift cylinder due to the damper effect of the hydraulic pressure accumulator, so as to give the operator a sense of discomfort as if the start timing of excavation has been delayed. In addition, when the vehicle speed is higher than the set speed during the loading work, the control valve is automatically changed over from the closed state to the open state. As a result, the oscillation of the bucket increases due to the damper effect of the hydraulic pressure accumulator, so as to give a needless sense of insecurity to the operator. In order to solve such problems, the applicant of the present application has already made a proposal in which a position of excavation, a position of hauling and a position of loading are set in a controller in advance, and a control valve is kept in a closed state in spite of a vehicle speed not lower than a set speed when a bucket is in a position not higher than the set position of excavation or not lower than the set position of loading (Japanese Patent Application No. 2011-56644). In this manner, the bucket can be prevented from oscillating during excavation work or during loading work, so that the sense of discomfort or the sense of insecurity can be removed from the operator.

In addition, in the background art, a work vehicle such as a wheel loader is also mounted with a transmission control device which automatically changes a speed stage of a transmission when the vehicle speed reaches a set speed. However, in the configuration in which the speed stage of the transmission is automatically changed in accordance with only the vehicle speed, shift-up operation may be performed against the operator's intention to accelerate the work vehicle when the vehicle speed is higher than the set speed. Thus, the work efficiency may deteriorate instead. For example, the following work is performed when soil etc. fully loaded on the bucket is loaded onto a dump truck. That is, the work vehicle is moved forward from the position of excavation toward the stop position of the dump truck. As soon as the work vehicle comes close up to a predetermined position from the dump truck, the amount of accelerator pedal depression is reduced to lower the vehicle speed. The bucket is lifted up to the loading height onto the dump truck while the work vehicle is moved forward due to an inertia force. The work vehicle is stopped in the loading position of the soil etc. However, when the vehicle speed is high, shift-up operation is carried out in spite of a small amount of accelerator pedal depression. Thus, the work vehicle may be accelerated. On this occasion, the operator must brake and stop the work vehicle in the loading position of the soil etc. Thus, the work efficiency deteriorates. In order to solve such a problem, the applicant of the present application has already proposed a transmission control device in which a loading position is set in a controller in advance, and shift-up operation by a transmission device is inhibited when the vehicle speed reaches a set speed or higher as long as a bucket is not lower than the set loading position (for example, see Patent Literature 2). In this manner, needless braking operation can be avoided so that the work efficiency of the work vehicle can be improved.

CITATION LIST

Patent Literature

Patent Literature 1: JP-A-05-209422
Patent Literature 2: JP-A-2011-1712

SUMMARY OF INVENTION

Technical Problem

In the work vehicle provided with the ride control device, as described above, the closing/opening operation of the control valve is controlled in consideration of the height position of the work tool such as a bucket, so that the sense of discomfort or the sense of insecurity can be removed from the operator. In addition, in the work vehicle provided with the automatic transmission control device, control to inhibit shift-up operation is carried out in consideration of the height position of the work tool such as a bucket, so that the work efficiency can be improved. In order to obtain these effects, the height of the work tool during the excavation work, the height of the work tool during the hauling work and the height of the work tool during the loading work are required to be set properly as threshold values of control for the closing/opening operation of the control valve provided in the ride control device or for the automatic transmission control device.

However, the heights of the work tool depend on the preferences or habits of operators. Therefore, when the heights of the work tool are decided in one and the same way, it is difficult for all the operators to always obtain the aforementioned effects. For example, even when a certain value is set as the height of the work tool during the hauling work as to the control of the ride control device, the control valve cannot be changed over from the closed state to the open state during the hauling work for an operator who has a habit of travelling the work vehicle with the work tool kept at a height lower than the set height of the work tool. Thus, the effect of suppressing the vibration of the vehicle body by the ride control device cannot be obtained. Such a problem may occur in the same manner when the height of the work tool during the excavation work or the height of the work tool during the loading work does not match with the preference or habit of an operator.

The present invention has been developed in consideration of the problems belonging to the background art. An object of the invention is to provide a work vehicle which is capable of appropriately setting the height of a work tool as a control threshold value for a ride control device or an automatic transmission control device, and which is excellent in operability and work efficiency.

Solution to Problems

In order to solve the foregoing problems, the invention provides a work vehicle including: a work tool which is moved vertically within a predetermined movable range by driving of a lift cylinder; a sensor which detects a height position of the work tool; and a controller which serves to control driving of a control target; wherein: the controller includes a signal import unit which imports a detection signal of the sensor as a signal of an excavation position by manual operation of an operator, a height position storage unit in which a specific height position of the work tool is stored as an offset value from the excavation position as to the control of driving of the control target, and a signal generating unit which generates a control signal for the control target in accordance with a height position of the work tool obtained from the detection signal of the sensor as soon as the obtained height position reaches the height position of the work tool stored in the height position storage unit.

The control target may include at least one of a ride control device by which circulation of hydraulic oil between the lift cylinder and a hydraulic pressure accumulator is changed over in accordance with a vehicle speed and the height position of the work tool, and a transmission control device by which a speed stage of a transmission is changed over in accordance with the vehicle speed, an engine speed and the height position of the work tool.

The sensor detects the height position of the work tool and outputs a detection signal in accordance with the detected height position of the work tool. The signal import unit is of a manual operation type. In response to the operation by the operator, the detection signal of the sensor in accordance with the height position of the work tool at that time is imported as an excavation position signal. The height of the work tool is desirably decided when the operator operates the signal import unit. Thus, the operator can reflect his/her own preference or habit on the setting of the excavation position. On the other hand, a specific height position serving for controlling the driving of a control target such as the ride control device or the transmission control device, for example, the height of the work tool during the hauling work, the height of the work tool during the loading work, or the like, is stored in the height position storage unit as an offset value from the excavation position set by the operation of the signal import unit. The operator generally uses the amount of lifting-up of the work tool from the excavation position so as to adjust the height of the work tool during the hauling work, the height of the work tool during the loading work, etc. Therefore, when the specific height positions are stored in the height position storage unit as offset values from the excavation position, the preference or habit of the operator can be also reflected on these specific height positions. Accordingly, a control signal for always appropriately controlling driving of the control target such as the ride control device or the transmission control device in accordance with the height position of the work tool can be generated in the signal generating unit, so that the operability and the work efficiency of the work vehicle can be improved.

Advantageous Effects of Invention

According to the invention, a controller serving for controlling the driving of a control target is provided with a signal import unit by which a detection signal of a sensor for detecting the height position of a work tool is imported as a signal of an excavation position by manual operation of an operator, a height position storage unit in which a specific height position of the work tool is stored as an offset value from the excavation position imported by the signal import unit as to the control of the driving of the control target, and a signal generating unit which generates a control signal for the control target in accordance with a height position of the work tool obtained from the detection signal of the sensor as soon as the obtained height position reaches the height position of the work tool stored in the height position storage unit. Accordingly, the preference or habit of the operator can be reflected on the setting of the excavation position and the setting of the specific height position so that the operability and the work efficiency of the work vehicle can be improved.

BRIEF DESCRIPTION OF DRAWINGS

FIG. 4 A table for explaining a height position and a flag stored in the main controller according to Example 1.

DESCRIPTION OF EMBODIMENTS

Embodiments of a work vehicle according to the invention will be described below along with Examples with reference to the drawings, using a wheel loader by way of example.

Example 1

A work vehicle according to Example 1 is characterized in that the invention is applied to a travel vibration suppression device called a ride control device.

Figure 1:
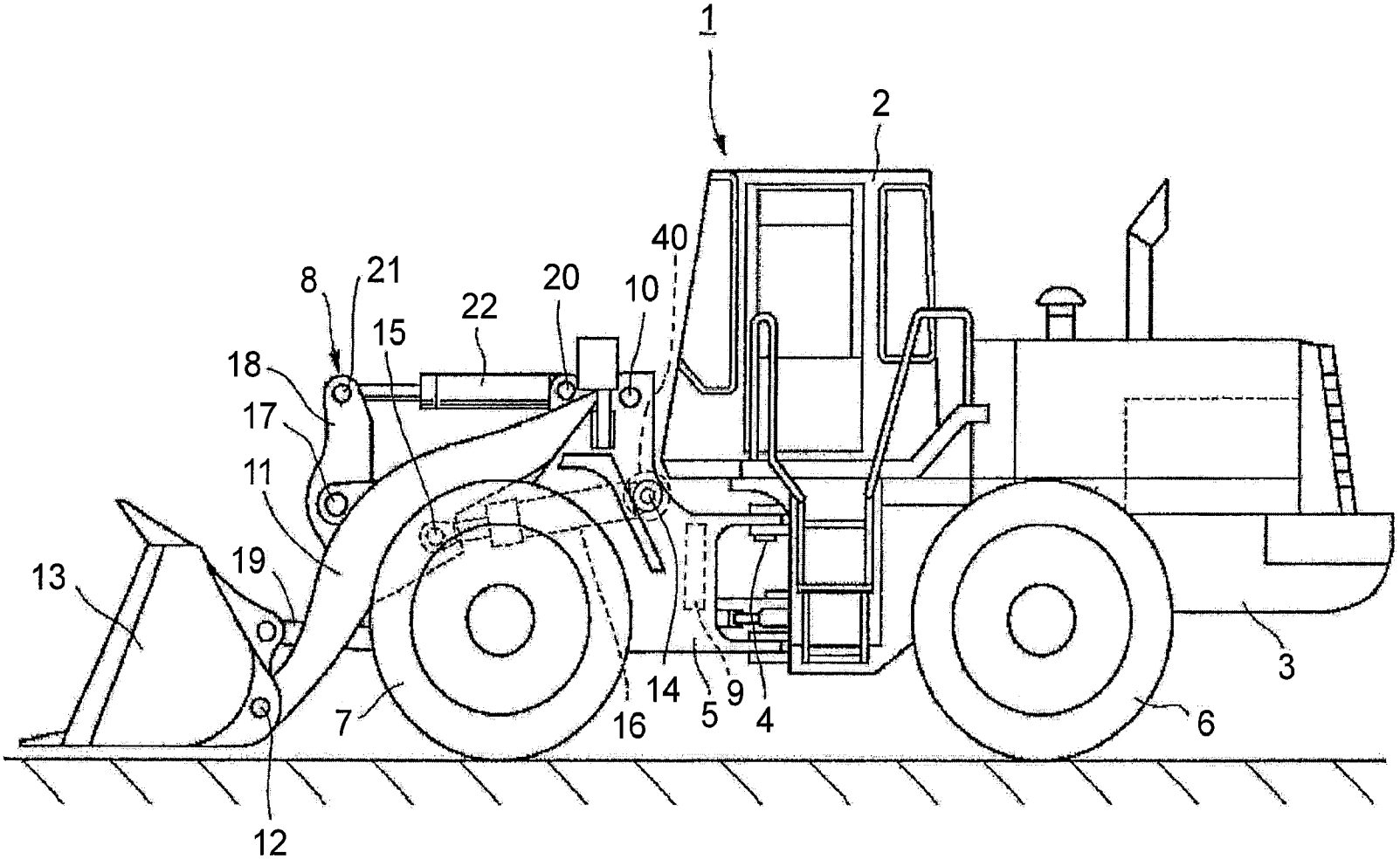
FIG. 1 An outline configuration view of a work vehicle according to Example 1.

As shown in FIG. 1, a wheel loader 1 according to the embodiment is mainly constituted by a rear vehicle body 3 provided with a cab 2, a front vehicle body 5 connected to the front side (on the forward moving side of the wheel loader 1) of the rear vehicle body 3 through a connection pin 4, rear wheels 6 and front wheels 7 provided in the rear vehicle body 3 and the front vehicle body 5, a front work machine 8 attached to a front portion of the front vehicle body 5, and a travel vibration suppression device 9 added to a hydraulic system of the front work machine 8.

Figure 2:
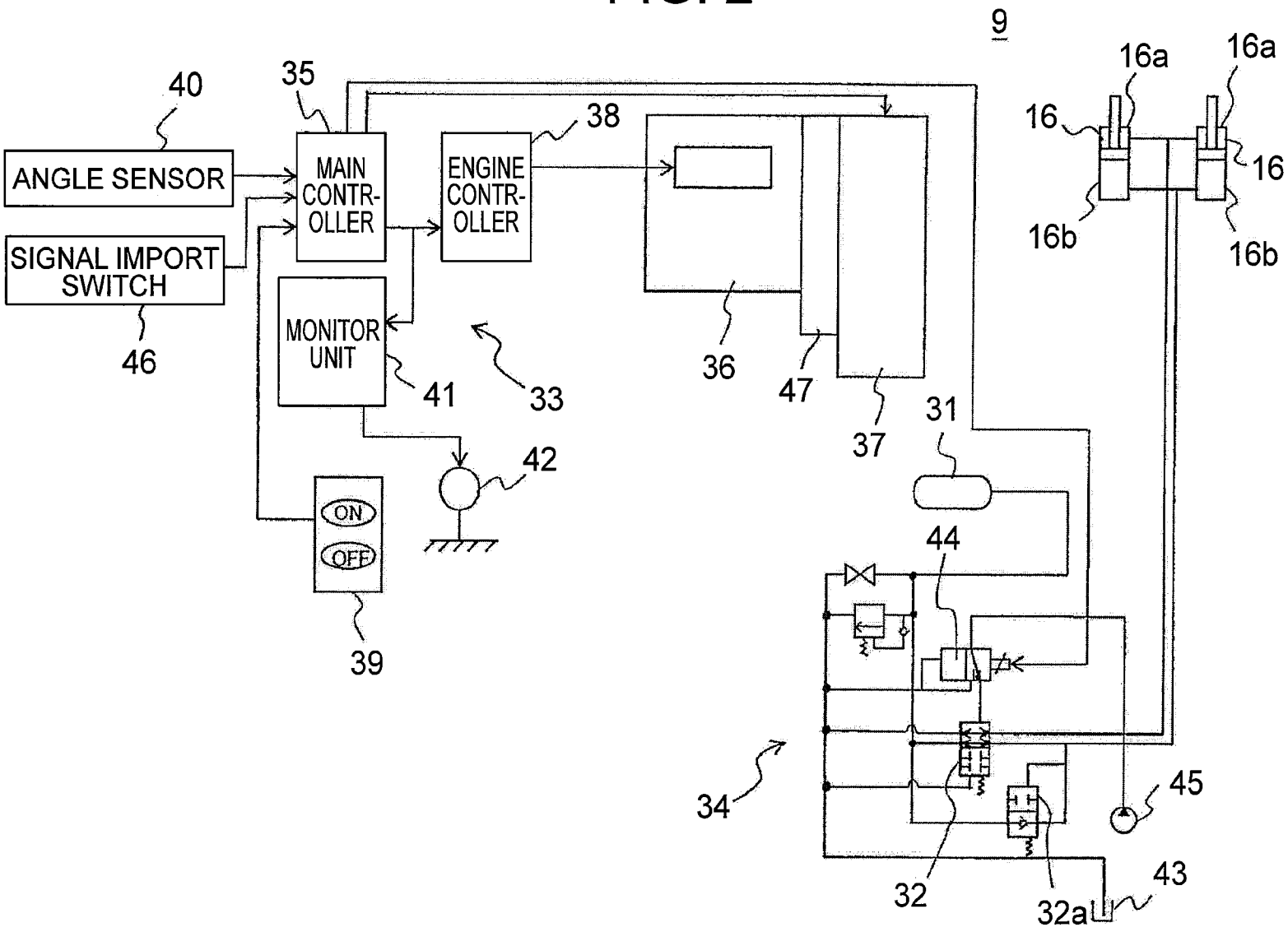
FIG. 2 A configuration diagram of a travel vibration suppression device according to Example 1.

The rear wheels 6 and the front wheels 7 are connected to a transmission 37 (see FIG. 2) mounted on the rear vehicle body 3, and driven by an engine 36 likewise mounted on the rear vehicle body 3 (see FIG. 2). On the other hand, the front work machine 8 is driven by hydraulic oil ejected from a not-shown hydraulic pump which is driven by the engine 36. The not-shown hydraulic pump and the travel vibration suppression device 9 are mounted on the front vehicle body 5. The front vehicle body 5 is configured to be bent in the left/right direction with respect to the rear vehicle body 3. During the hauling work, a not-shown steering device provided in the cab 2 is operated to bend the front vehicle body 5 in the left direction or the right direction with respect to the rear vehicle body 3 to thereby move the wheel loader 1 in that direction.

The front work machine 8 is constituted by an arm 11, a bucket (work tool) 13, a lift cylinder 16, a bell crank 18, a link member 19 and a bucket tilting cylinder 22. One end of the arm 11 is connected to the front vehicle body 5 through a connection pin 10. The bucket 13 is attached to a front end portion of the arm 11 through a connection pin 12. Opposite end portions of the lift cylinder 16 are connected to the front vehicle body 5 and the arm 11 through connection pins 14 and 15. The bell crank 18 is swingably connected to the arm 11 through a connection pin 17. The link member 19 has one end connected to the bell crank 18 and the other end connected to the bucket 13. Opposite end portions of the bucket tilting cylinder 22 are connected to the front vehicle body 5 and the bell crank 18 through connection pins 20 and 21. Although one arm 11, one connection pin 12, one connection pin 14, one connection pin 15 and one lift cylinder 16 are provided in this Example, a pair of arms 11, a pair of connection pins 12, a pair of connection pins 14, a pair of connection pins 15 and a pair of lift cylinders 16 are provided on the left and right sides of the bucket 13 in a real machine.

The lift cylinder 16 and the bucket tilting cylinder 22 are driven by hydraulic oil ejected from a not-shown hydraulic pump. When the lift cylinder 16 is extended, the arm 11 and the bucket 13 move up. When the lift cylinder 16 is shrunk, the arm 11 and the bucket 13 move down. The extension and shrinkage of the lift cylinder 16, that is, the upward and downward movement of the arm 11 and the bucket 13 can be carried out by operation on an operating instrument such as a control lever provided in the cab 2. On the other hand, when the bucket tilting cylinder 22 is extended, the bucket 13 swings upward. When the bucket tilting cylinder 22 is shrunk, the bucket 13 swings downward. The extension and shrinkage of the bucket tilting cylinder 22, that is, the upward and downward swing of the bucket 13 can be carried out by operation on an operating instrument such as a control lever provided in the cab 2.

As shown in FIG. 2, the travel vibration suppression device 9 is constituted by a hydraulic pressure accumulator 31, a control valve 32, a ride control portion 33 and a hydraulic circuit 34. Hydraulic oil circulates between the hydraulic pressure accumulator 31 and the lift cylinder 16. The flow of the hydraulic oil between the lift cylinder 16 and the hydraulic pressure accumulator 31 is changed over by the control valve 32. The open/close state of the control valve 32 is changed over by the ride control portion 33. The control valve 32 is operated to open and close by the hydraulic circuit 34 in accordance with an instruction from the ride control portion 33. Although only one hydraulic pressure accumulator 31 is depicted in FIG. 2, a plurality of hydraulic pressure accumulators 31 may be provided in accordance with the size and volume of a hydraulic system in use.

The ride control portion 33 is constituted by a main controller 35, an engine controller 38, a ride control switch 39, an angle sensor 40, an indicator 42 and a manual operation type signal import switch (signal import unit) 46. The main controller 35 manages the entire control of the wheel loader 1. In response to an instruction from the main controller 35, the engine controller 38 controls driving of the engine 36 and the transmission 37. The ride control switch 39 is operated by the operator. The angle sensor 40 is attached coaxially with the connection pin 10 so as to detect the swing angle of the arm 11 with respect to the front vehicle body 5. The indicator 42 is connected to the main controller 35 through a monitor unit 41. The signal import switch 46 imports a detection signal of the angle sensor 40 into a storage portion in the main controller 35. The reference numeral 47 in FIG. 2 represents a torque converter which is a fluid joint provided between the engine 36 and the transmission 37.

Although the aforementioned embodiment has a configuration in such a manner that driving of the engine 36 and driving of the transmission 37 are controlled by the engine controller 38, the configuration may be replaced by a configuration in which driving of the engine 36 and driving of the transmission 37 are controlled using controllers dedicated thereto respectively. In addition, although the aforementioned embodiment has a configuration in such a manner that the indicator 42 is connected to the main controller 35 through the monitor unit 41, the configuration may be replaced by a configuration in which the indicator 42 is displayed within the monitor unit 41. Further, although the aforementioned embodiment has a configuration in such a manner that the manual operation type signal import switch 46 is connected to the main controller 35, the configuration may be replaced by a configuration in which the signal import switch 46 is displayed within the monitor unit 41.

The ride control switch 39 consists of an on/off switch, whose output signal is inputted to the main controller 35. When the operator operates to turn on the ride control switch 39, the main controller 35 outputs a changeover signal for the control valve 32 to change over the control valve 32 to the open state, so that the hydraulic oil can circulate between the lift cylinder 16 and the hydraulic pressure accumulator 31. On the contrary, when the operator operates to turn off the ride control switch 39, the main controller 35 outputs a changeover signal for the control valve 32 to change over the control valve 32 to the closed state, so as to block the circulation of the hydraulic oil between the lift cylinder 16 and the hydraulic pressure accumulator 31. The operating state of the ride control switch 39 is displayed on the indicator 42 through the monitor unit 41.

The main controller 35 controls driving of the engine 36 through the engine controller 38, and at the same time, controls driving of the control valve 32 and the monitor unit 41. The control of the driving of the engine 36 and the control of the driving of the monitor unit 41 are well-known matters and not the scope and spirit of the invention. Therefore, their description will be omitted.

Figure 3:
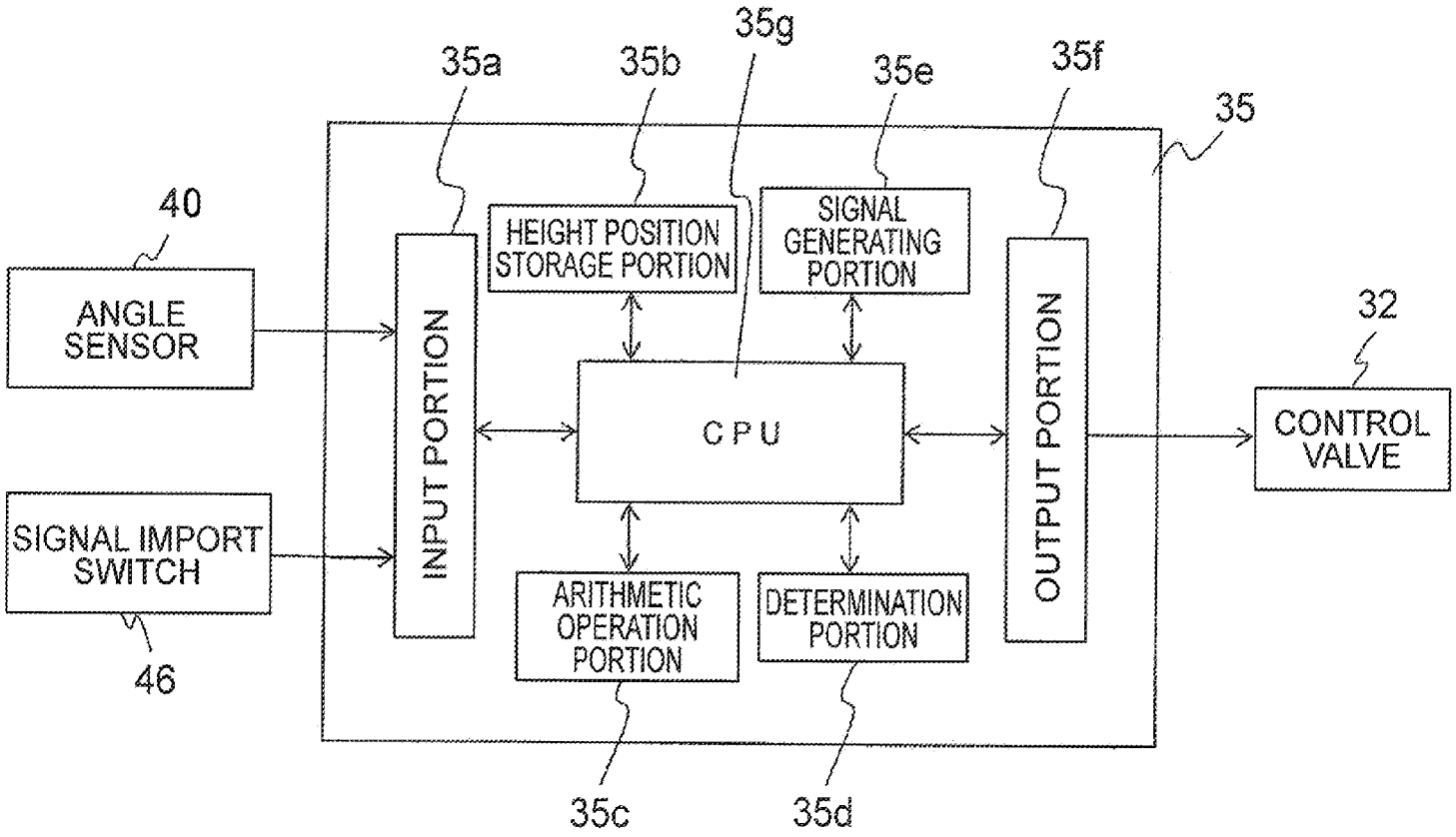
FIG. 3 A configuration diagram of a main controller according to Example 1.

As for the control of the driving of the control valve 32, as shown in FIG. 3, the main controller 35 includes an input portion 35*a*, a height position storage portion 35*b*, an arithmetic operation portion 35*c*, a determination portion 35*d*, a signal generating portion 35*e*, an output portion 35*f* and a CPU 35*g*. The input portion 35*a* imports a detection signal of the angle sensor 39 and an output signal of the signal import switch 46. The height position storage portion 35*b* stores a height position of the bucket 13. The arithmetic operation portion 35*c* calculates the height position of the bucket 13 from the detection signal of the angle sensor 39. The determination portion 35*d* determines whether the height position of the bucket 13 calculated by the arithmetic operation portion 35*c* reaches the specific height position stored in the height position storage portion 35*b* or not. The signal generating portion 35*e* generates an on/off signal for the control valve 32 in accordance with the height position of the bucket 13 calculated by the arithmetic operation portion 35*c* when the determination portion 35*d* concludes that the height position reaches the specific height position stored in the height position storage portion 35*b*. The output portion 35*f* outputs the on/off signal generated by the signal generating portion 35*e* to the control valve 32. The CPU 35*g* drives these respective portions 35*a* to 35*f* along a predetermined program.

The arithmetic operation portion 35*c* calculates the height position of the bucket 13 from the detection signal of the angle sensor 40. In this embodiment, the height position of the bucket 13 corresponds to the height position of the connection pin 12 which connects the arm 11 with the bucket 13. The height position of the bucket 13 can be calculated from the swing radius of the connection pin 12 which is a known value, and the detection value of the angle sensor 39.

A detection value of the angle sensor 39 obtained when the signal import switch 46 is operated by the operator is stored in the height position storage portion 35*b*. In addition, height position information as a reference for on/off control of the control valve 32, such as height position information of the bucket 13 during hauling work or height position information of the bucket 13 during loading work is stored in the height position storage portion 35*b* in advance. When the operator operates the signal import switch 46 in the state where the bucket 13 has been moved down to an excavation position, the detection value of the angle sensor 39 obtained at that time is stored in the height position storage portion 35*b*. Accordingly, the height position information stored in the height position storage portion 35*b* in response to the operation performed on the signal import switch 46 serves as height position information of the bucket 13 in the excavation position on which the preference or habit of the operator is reflected. In addition, the height position information of the bucket 13 stored in the height position storage portion 35*b* in advance is stored as an offset value from the height position stored in the height position storage portion 35*b* in response to the operation performed on the signal import switch 46. The operator generally adjusts the bucket height during the hauling work, the bucket height during the loading work, etc. by means of the lifting-up amount of the bucket 13 from the excavation position. Accordingly, when the bucket height during the hauling work and the bucket height during the loading work are stored in the height position storage portion 35*b* as offset values from the excavation position, the preference or habit of the operator can be reflected on those height positions.

FIG. 4 shows a storage format of the height position storage portion 35*b*. In this Example, as shown in FIG. 4, a lower limit position H0 and an upper limit position H4 of a movable range, an excavation position H1 which is as high as or higher than the lower limit position H0 and which is set by the operator operating the signal import switch 46, a hauling position H2 which is higher than the excavation position H1, and a loading position H3 which is lower than the upper limit position H4 and higher than the hauling position H2, are stored as to the vertical moving direction of the bucket 13. The lower limit position H0 of the bucket 13 is a position where the outer surface of the bucket 13 abuts against the ground, and the upper limit position H4 depends on the vehicle rank (size) of the wheel loader 1. In addition, the hauling position H2 corresponds to the height position of the bucket 13 during the hauling work, and the loading position H3 corresponds to the height position of the bucket 13 during the loading work. Each of the hauling position H2 and the loading position H3 is stored as an offset quantity from the excavation position H1.

In addition, a flag for selecting whether to permit to automatically change over the control valve 32 in accordance with the height position of the bucket 13 or not is stored in the height position storage portion 35*b* as shown in FIG. 4. In the example of FIG. 4, a check mark indicating permission to automatically change over the control valve 32 is stored for each of the case where the height position H of the bucket 13 is in a range of $H0 \leq H \leq (H1+H2)$, the case where the height position H of the bucket 13 is in a range of $(H1+H2) < H < (H1+H3)$ and the case where the height position H of the bucket 13 is in a range of $(H1+H3) \leq H \leq H4$. Thus, the control valve 32 is automatically changed over in accordance with the height position H of the bucket 13 in the whole movable range of the bucket 13. That is, in this example, the control valve 32 is changed over to the closed state when the height position H of the bucket 13 is in a range of $H0 \leq H \leq (H1+H2)$ or when the height position H of the bucket 13 is in a range of $(H1+H3) \leq H \leq H4$, and the control valve 32 is changed over to the open state when the height position H of the bucket 13 is in a range of $(H1+H2) < H < (H1+H3)$. In this manner, the bucket 13 can be prevented from oscillating during the excavation work and during the loading work. Thus, those works can be performed without any sense of discomfort, so that the sense of discomfort and the sense of insecurity can be eliminated from the operator. On the other hand, fluctuation in gravity of the bucket 13 acting on the front vehicle body 5 is reduced due to the damper effect of the hydraulic pressure accumulator 31 during the hauling work, so that the travelling stability of the wheel loader 1 can be enhanced. The operation of the main controller 35 will be described later more in detail with reference to FIG. 5.

The hydraulic circuit 34 is configured as follows. That is, as shown in FIG. 2, a rod-side chamber 16*a* of the lift cylinder 16 is connected to a hydraulic oil tank 43 through the control valve 32, and a bottom-side chamber 16*b* of the lift cylinder 16 is connected to the hydraulic pressure accumulator 31 through the control valve 32. The control valve 32 is a pilot operation valve, which is opened/closed in accordance with a hydraulic pilot signal from an electromagnetic pilot valve 44 for ride control. When the control valve 32 is in the open state, hydraulic oil is permitted to circulate between the rod-side chamber 16*a* of the lift cylinder 16 and the hydraulic oil tank 43 and between the bottom-side chamber 16*b* of the lift cylinder 16 and the hydraulic pressure accumulator 31 so that a damper effect can be given to the vertical motion of the bucket 13. On the contrary, when the control valve 32 is in the closed state, hydraulic oil is not permitted to circulate between the rod-side chamber 16*a* of the lift cylinder 16 and the hydraulic oil tank 43 and between the bottom-side chamber 16*b* of the lift cylinder 16 and the hydraulic pressure accumulator 31 so that the weight of the bucket 13 can act directly on the front vehicle body 5 through the lift cylinder 16.

The electromagnetic pilot valve 44 is operated to be changed over in accordance with a changeover signal outputted from the main controller 35. That is, when a signal for changing over the control valve 32 to the open state is outputted from the main controller 35, the electromagnetic pilot valve 44 opens an oil path to introduce the pilot pressure ejected from the pilot pump 45 to a pilot port of the control valve 32 so that the control valve 32 can be changed over to the open state. On the other hand, when a signal for changing over the control valve 32 to the closed state is outputted from the main controller 35, the electromagnetic pilot valve 44 opens an oil path to drop the pilot pressure down to the hydraulic oil tank 43 so that the control valve 32 can be changed over to the closed state due to the elastic force of a built-in return spring.

Figure 5:
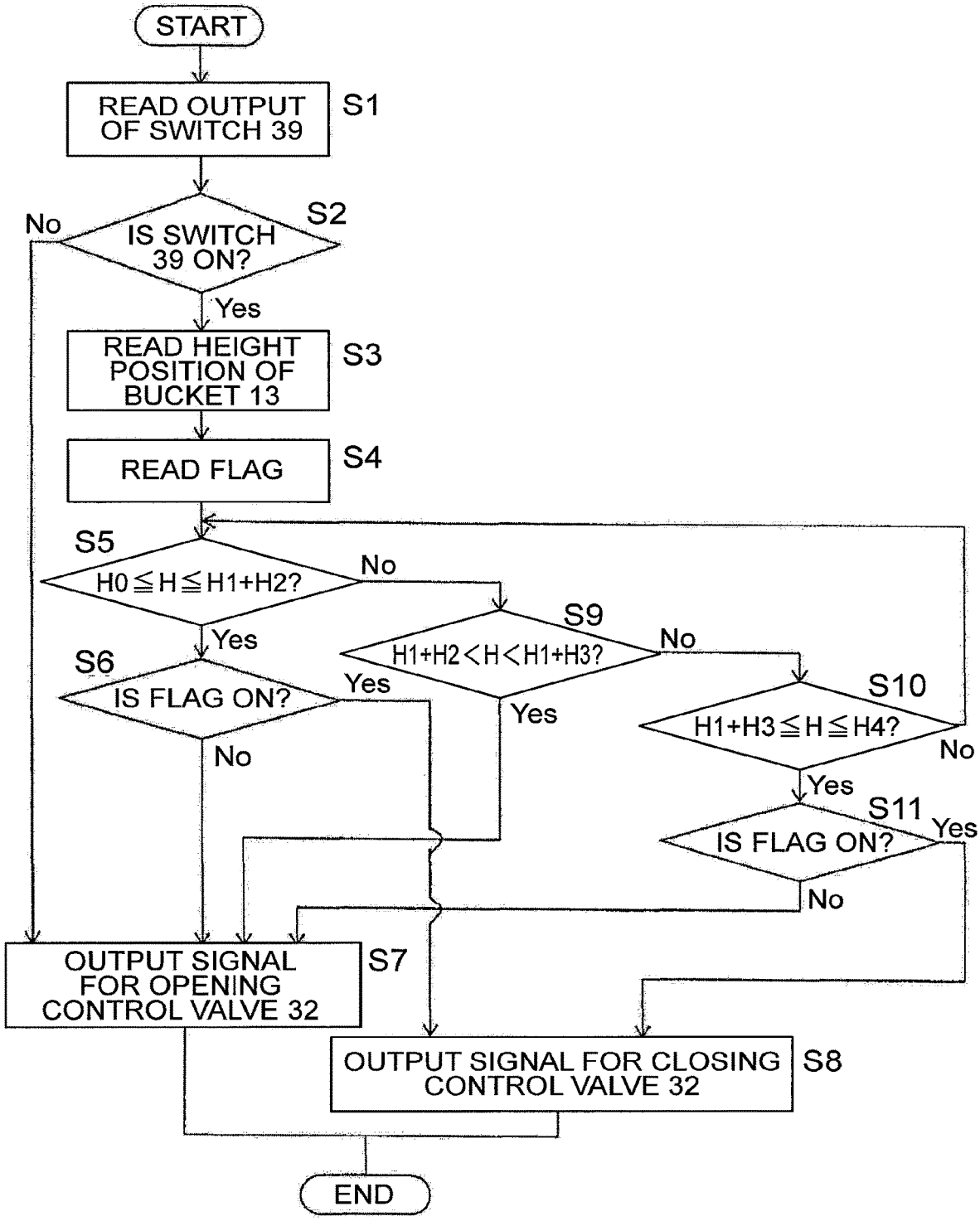
FIG. 5 A flow chart showing the operation of a work machine according to Example 1.

The operation of the work vehicle according to the embodiment will be described below with reference to FIG. 5. When the engine 36 is activated (started up), the main controller 35 reads an output signal of the ride control switch 39 (Step S1), and determines whether the output signal of the ride control switch 39 is an ON signal or not (Step S2). When it is concluded in Step S2 that the output signal of the ride control switch 39 is an OFF signal, the routine of processing moves to Step S7, and the system is terminated (ended).

When it is concluded in Step S2 that the output signal of the ride control switch 39 is an ON signal, the height position of the bucket 13 calculated by the main controller 35 is read (Step S3), and the flag stored in the main controller 35 is read (Step S4). After that, determination as to whether the read height position H of the bucket 13 is in a range of $H0 \leq H \leq (H1+H2)$ or not (Step S5) and determination as to whether permission to automatically change over the control valve 32 is given to the range of $H0 \leq H \leq (H1+H2)$ by the operator or not (Step S6) are carried out in this order. When it is concluded in Step S5 that the height position H of the bucket 13 is in the range of $H0 \leq H \leq (H1+H2)$ and it is concluded in Step S6 that permission to automatically change over the control valve 32 is given to the range of $H0 \leq H \leq (H1+H2)$, the routine of processing moves to Step S8, in which a signal for changing over the control valve 32 to the closed state is outputted to the electromagnetic pilot valve 44. When it is concluded in Step S6 that permission to automatically change over the control valve 32 is not given to the range of $H0 \leq H \leq (H1+H2)$, the routine of processing moves to Step S7, in which a signal for changing over the control valve 32 to the open state is outputted to the electromagnetic pilot valve 44.

When it is concluded in Step S5 that the height position H of the bucket 13 is not in the range of $H0 \leq H \leq (H1+H2)$, the routine of processing moves to Step S9, in which it is determined whether the height position H of the bucket 13 is in a range of $(H1+H2) < H < (H1+H3)$ or not. When it is concluded in Step S9 that the height position H of the bucket 13 is in the range of $(H1+H2) < H < (H1+H3)$, the routine of processing moves to Step S7, in which a signal for changing over the control valve 32 to the open state is outputted to the electromagnetic pilot valve 44.

Further, it is concluded in Step S9 that the height position H of the bucket 13 is not in the range of $(H1+H2) < H < (H1+H3)$, determination as to whether the height position H of the bucket 13 is in a range of $(H1+H3) \leq H \leq H4$ or not (Step S10) and determination as to whether permission to automatically change over the control valve 32 is given to the range of $(H1+H3) \leq H \leq H4$ by the operator or not (Step S11) are carried out in this order. When it is concluded in Step S10 that the height position H of the bucket 13 is in the range of $(H1+H3) \leq H \leq H4$ and it is concluded in Step S11 that permission to automatically change over the control valve 32 is given to the range of $(H1+H3) \leq H \leq H4$, the main controller 35 outputs, to the electromagnetic pilot valve 44, a signal for changing over the control valve 32 to the closed state. When it is concluded in Step S10 that permission to automatically change over the control valve 32 is not given to the range of $(H1+H3) \leq H \leq H4$, the routine of processing moves to Step S7, in which a signal for changing over the control valve 32 to the open state is outputted to the electromagnetic pilot valve 44.

In this manner, the work vehicle according to Example 1 can reflect the preference or habit of the operator on the height positions of the bucket 13 during the excavation work, during the hauling work and during the loading work, which height positions are involved in the control to open/close the control valve 32 provided in the travel vibration suppression device. Thus, the control valve 32 can be prevented from being opened/closed in a state which is not intended by the operator, so that the travelling stability and the work efficiency of the wheel loader 1 can be improved.

Example 2

Next, Example 2 of the work vehicle according to the invention will be described. The work vehicle according to Example 2 is characterized in that the invention is applied to a transmission control device mounted on a wheel loader. The wheel loader has the same outline configuration as that of the wheel loader 1 according to Example 1 shown in FIG. 1.

Figure 6:
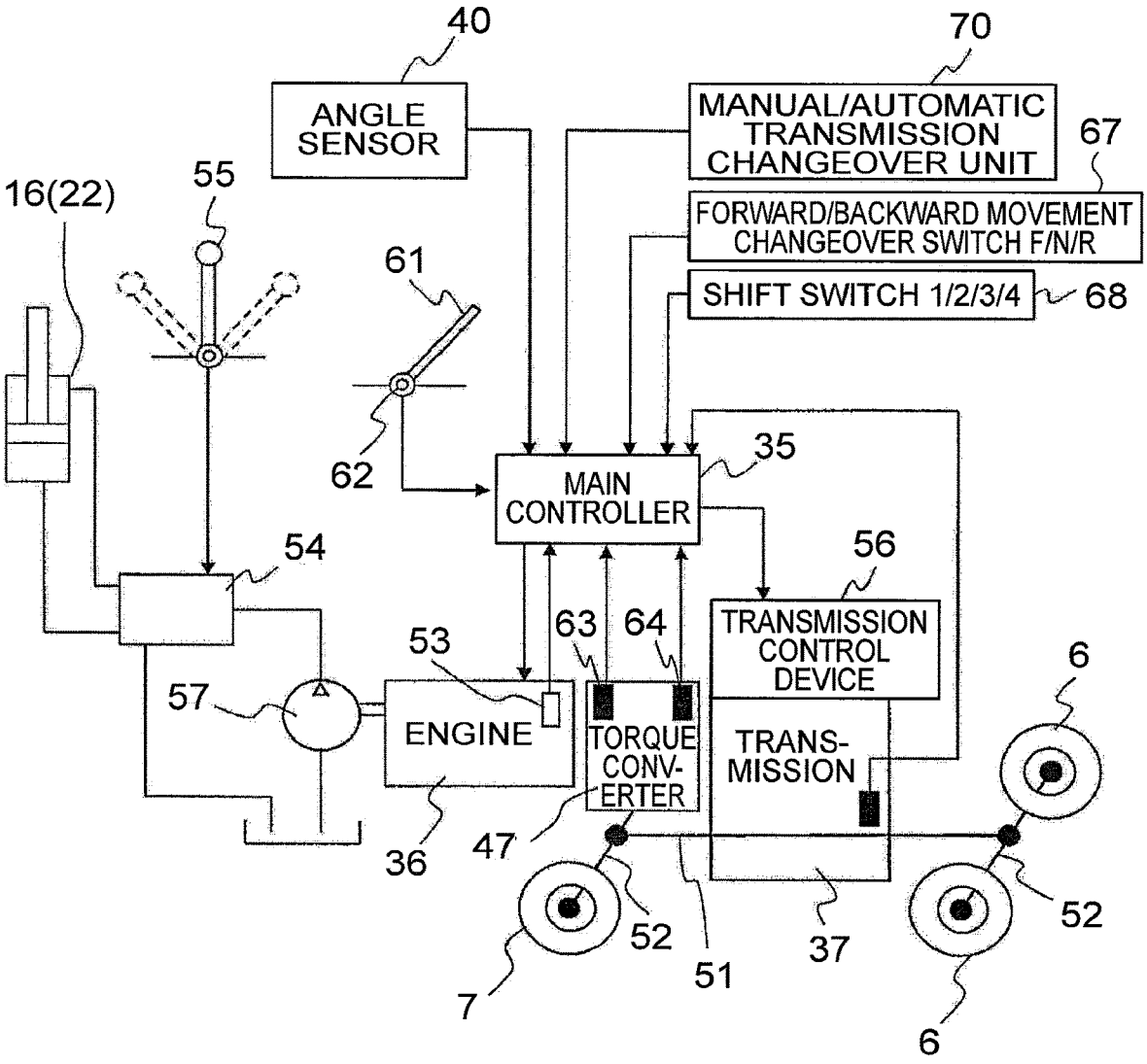
FIG. 6 A configuration diagram of a transmission control device provided in a work machine according to Example 2.

As shown in FIG. 6, a not-shown input shaft of a torque converter 47 is linked with an output shaft of an engine 36 mounted on the wheel loader 1, and a not-shown output shaft of the torque converter 47 is linked with a transmission 37. The torque converter 47 is a well-known fluid clutch which consists of an impeller, a turbine and a stator, so that the rotation of the engine 36 can be transmitted to the transmission 37 through the torque converter 47. The transmission 37 has a hydraulic pressure clutch for shifting its speed stage to any one of first to fourth gears, so that the rotation of the output shaft of the torque converter 47 can be shifted by the transmission 37. The shifted rotation is transmitted to the front wheels 7 and the rear wheels 6 through a propeller shaft 51 and an axle 52 so that the wheel loader 1 can travel. The engine speed of the engine 36 is detected by an engine speed sensor 53.

In addition, the engine 36 drives a hydraulic pump 57 for working. Hydraulic oil ejected from the hydraulic pump 57 for working is introduced into a lift cylinder 16 and a bucket tilting cylinder 22 through a directional control valve 54. The directional control valve 54 is driven by operation on a control lever 55. The lift cylinder 16 and the bucket tilting cylinder 22 are driven in accordance with the operating amount of the control lever 55.

The torque converter 47 has a function of increasing output torque relatively to input torque, that is, a function of setting a torque ratio at 1 or higher. The torque ratio is reduced with the increase of a torque converter speed ratio e (=Nt/Ni) which is a ratio between the number Ni of rotations of the input shaft of the torque converter 47 and the number Nt of rotations of the output shaft of the same. For example, when a travel load increases during travel with a fixed engine speed, the number of rotations of the output shaft of the torque converter 47, that is, the vehicle speed decreases, and the torque converter speed ratio e decreases. On this occasion, the vehicle can travel with a larger drive force (traction) due to the increase in torque ratio.

The transmission 37 is an automatic transmission with solenoid valves corresponding to respective speed stages. These solenoid valves are driven in accordance with a control signal outputted from a main controller 35 to a transmission control device 56, so that the speed stage can be automatically shifted to anyone of the first to fourth gears. In this Example, for example, the stage of the first gear to the stage of the fourth gear are provided as the speed stages for the transmission 37.

There are two systems for automatic transmission control, that is, a system of torque converter speed ratio reference control in which a gear is shifted as soon as the torque converter speed ratio e reaches a predetermined value, and a system of vehicle speed reference control in which a gear is shifted as soon as the vehicle speed reaches a predetermined value. In this Example, the speed stage of the transmission 37 is controlled by the vehicle speed reference control.

Figure 7:
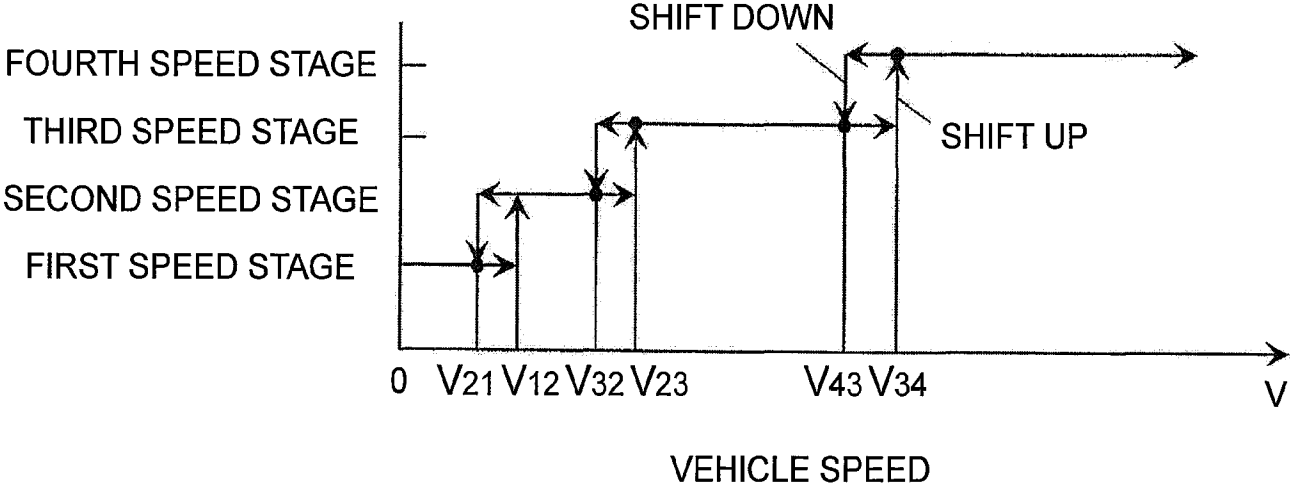
FIG. 7 A graph showing the relationship between a vehicle speed and a speed stage in the transmission control device according to Example 2.

FIG. 7 is a graph showing the relationship between a vehicle speed v and a speed stage. In this Example, the main controller 35 outputs a control signal to the transmission control device 56 in accordance with the vehicle speed v so as to shift a gear in the transmission 37 in accordance with the vehicle speed v as shown in FIG. 7. That is, when the vehicle speed v increases to a gear shift permission vehicle speed v12, the gear is shifted up from the first gear to the second gear. When the vehicle speed v increases from the gear shift permission vehicle speed v12 to a gear shift permission vehicle speed v23, the gear is shifted up from the second gear to the third gear. When the vehicle speed v increases from the gear shift permission vehicle speed v23 to a gear shift permission vehicle speed v34, the gear is shifted up from the third gear to the fourth gear. On the other hand, when the vehicle speed v decreases to a gear shift permission vehicle speed v43, the gear is shifted down from the fourth gear to the third gear. When the vehicle speed v decreases to a gear shift permission vehicle speed v32, the gear is shifted down from the third gear to the second gear. When the vehicle speed v decreases to a gear shift permission vehicle speed v21, the gear is shifted down from the second gear to the first gear. The gear shift permission vehicle speeds v12, v23 and v34 are set to be higher than the gear shift permission vehicle speeds v21, v32 and v43 respectively so that the gear can be shifted stably. Each of the gear shift permission vehicle speeds is a threshold value for permission to shift up or down the gear. The gear shift permission vehicle speeds are set in the main controller 35 in advance. The transmission control device 56 consists of solenoid valves corresponding to the respective speed stages. The solenoid valves are driven in accordance with a control signal from the main controller 35.

In this Example, the main controller 35 decreases the gear shift permission vehicle speeds when the engine speed of the engine 36 is low, and increases the gear shift permission vehicle speeds when the engine speed of the engine 36 is high. In this manner, the main controller 35 changes the gear shift permission vehicle speeds in accordance with the engine speed of the engine 36 so as to obtain an effect in reducing the fuel consumption.

Figure 8:
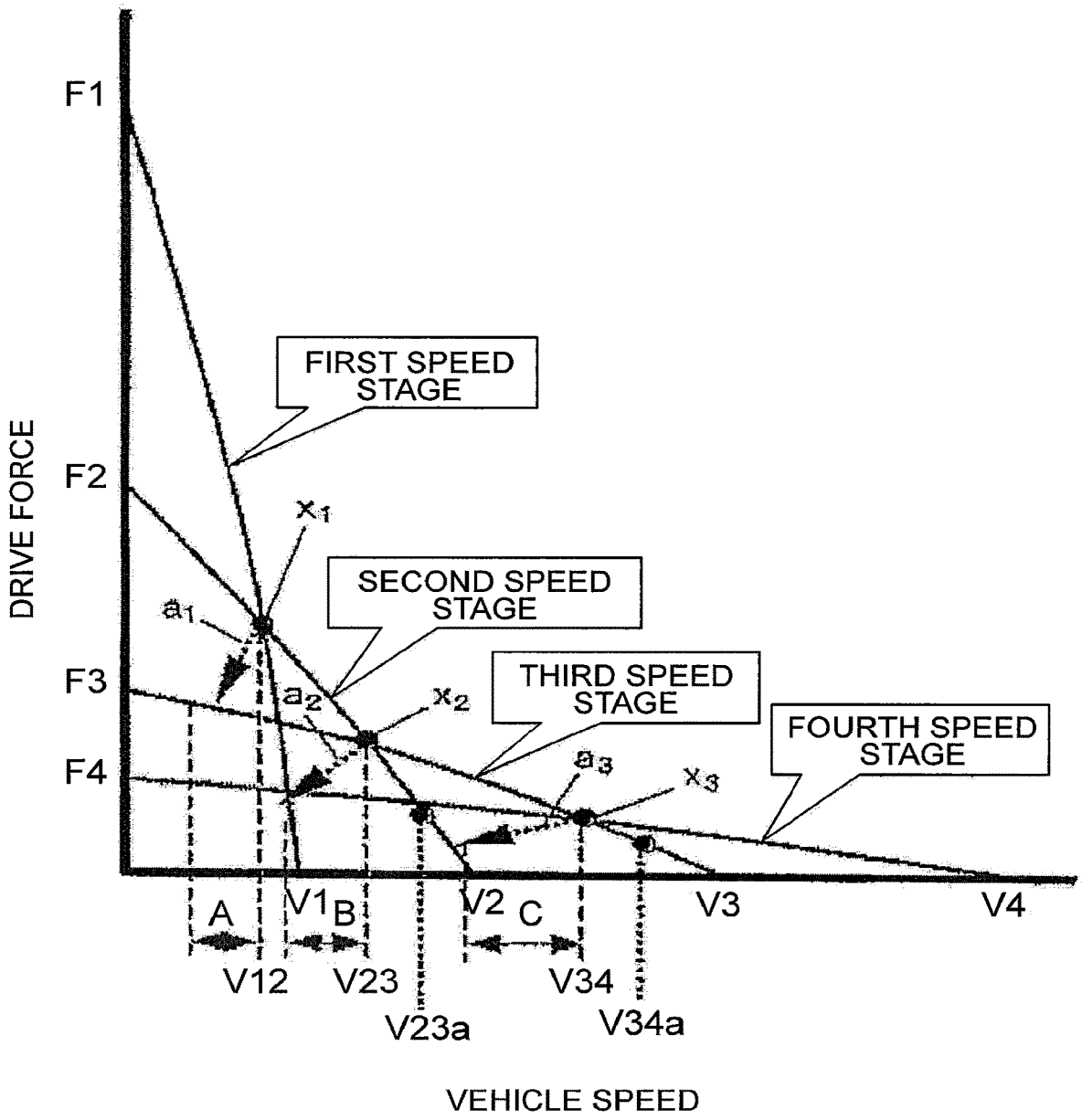
FIG. 8 A graph showing the travel performance of the work machine according to Example 2.

FIG. 8 is a graph showing the travel performance of the wheel loader 1 according to the Example. For the sake of convenience of explanation, only gear shift permission speeds for shifting up the gear (shift-up permission speeds) are depicted in FIG. 8. However, the same rule can be also applied to gear shift permission speeds for shifting down the gear (shift-down permission speeds). Intersection points x1, x2 and x3 of curves indicating travel performance in the respective speed stages move as shown by arrows a1, a2 and a3 respectively when the engine speed of the engine 36 decreases. The gear shift permission speeds are generally set at the intersection points x1, x2 and x3. In FIG. 8, vehicle speed ranges referenced by A, B and C designate the ranges where the gear shift permission speeds v12, v23 and v34 vary in accordance with the engine speed of the engine 36.

In this Example, a first set height and a second set height are defined for the height of the bucket 13 in advance. When the height of the bucket 13 exceeds the first set height, the main controller 35 increases (raises) the gear shift permission speeds v23 and v34 to gear shift permission vehicle speeds v23*a* and v34*a* as shown in FIG. 8 regardless of the engine speed of the engine 36, so that the gear is hardly shifted up from the second gear to the third gear or from the third gear to the fourth gear. On the other hand, when the height of the bucket 13 exceeds the second set height which is higher than the first set height, the main controller 35 forbids shifting up from the second gear to the third gear and from the third gear to the fourth gear. Here, the gear shift permission speeds v23*a* and v34*a* are set at values which are, for example, about 10% higher than the maximum values of the gear shift permission speeds v23 and v34 varying in accordance with the engine speed of the engine 36 respectively. Incidentally, even when the height of the bucket 13 exceeds the second set height, shifting down is not forbidden.

The first set height and the second set height are stored in the height position storage portion 35*b* as offset values from the excavation position which is imported into the height position storage portion 35*b* by the operator operating the signal import switch 46, in the same manner as in the work vehicle according to Example 1. In addition, the height position of the bucket 13 during the hauling work (a hauling position H2) and the height position of the bucket 13 during the loading work (a loading position H3) may be set as the first set height and the second set height, in the same manner as in the work vehicle according to Example 1.

As shown in FIG. 6, a pedal operation amount detector 62, a rotation number detector 63, a rotation number detector 64 and a vehicle speed detector 65 are connected to the main controller 35. The pedal operation amount detector 62 detects the amount of operation on an accelerator pedal 61. The rotation number detector 63 detects the number Ni of rotations in the input shaft of the torque converter 47. The rotation number detector 64 detects the number Nt of rotations in the output shaft of the torque converter 47. The vehicle speed detector 65 detects the rotation speed of the output shaft of the transmission 37, that is, the vehicle speed v. Further in addition, a forward/backward movement changeover switch 67, a shift switch 68, the aforementioned engine speed sensor 53, the aforementioned angle sensor 40 and a manual/automatic transmission changeover unit 70 are connected to the main controller 35. The forward/backward movement changeover switch 67 issues an instruction to move the vehicle forward/backward. The shift switch 68 issues an instruction of a maximum speed stage among the first to fourth gears. The manual/automatic transmission changeover unit 70 changes over the transmission 37 between automatic transmission and manual transmission.

The main controller 35 controls the engine speed (the number of rotations) of the engine 36 in accordance with the amount of operation on the accelerator pedal 61. In addition, as described above, the main controller 35 changes each gear shift permission vehicle speed in accordance with the height of the bucket 13 calculated based on the engine speed of the engine 36 detected by the engine speed sensor 53 and the height of the bucket 13 calculated based on the detection value of the angle sensor 40. Further, as will be described later, the main controller 35 does not permit output of a shift-up signal to the transmission control device 56, so as to forbid shifting up in the transmission 37.

Figure 9:
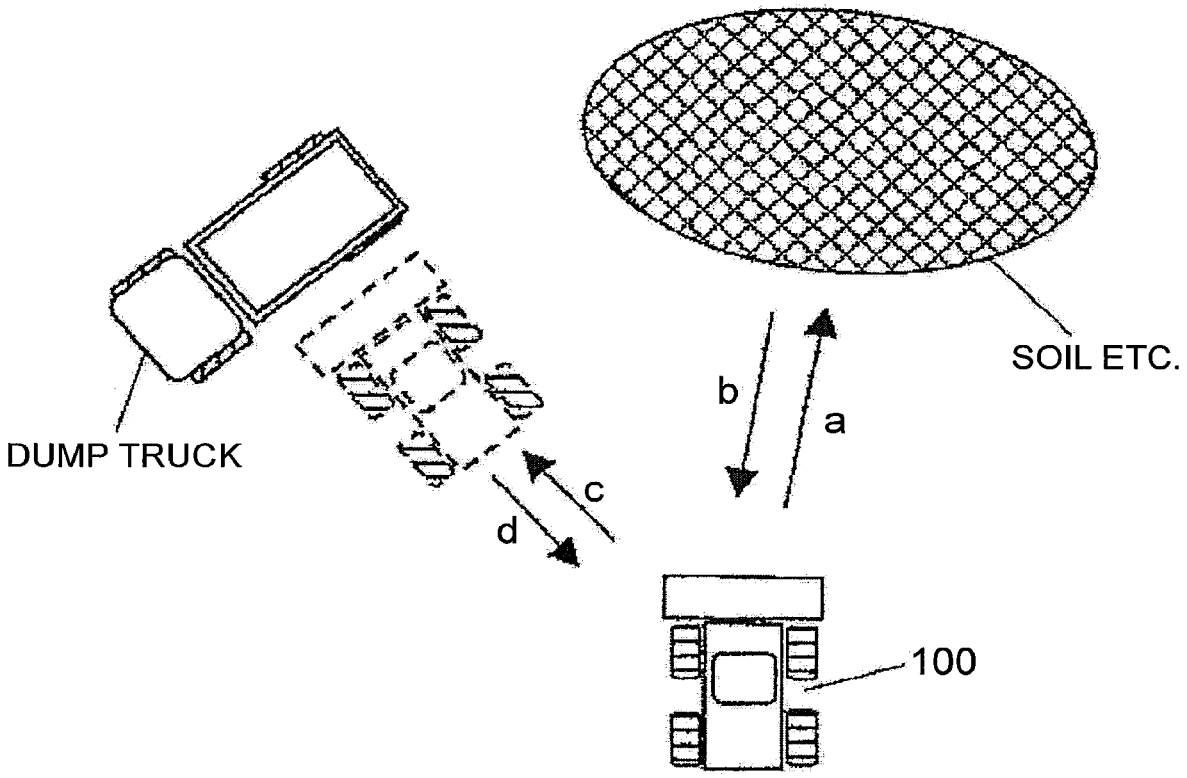
FIG. 9 A view for explaining V-shape loading using the work machine according to Example 2.

FIG. 9 is a view for explaining V-shape loading which is one of methods for loading soil etc. on a dump truck. In the V-shape loading, the wheel loader 1 is first moved forward to scoop up soil etc. as shown by the arrow a, and then the wheel loader 1 is once moved backward as shown by the arrow b. Then, the wheel loader 1 is moved forward toward the dump truck to load the scooped soil etc. on the dump truck as shown by the arrow c, and the wheel loader 1 is moved backward to its original position as shown by the arrow d.

Figure 10:
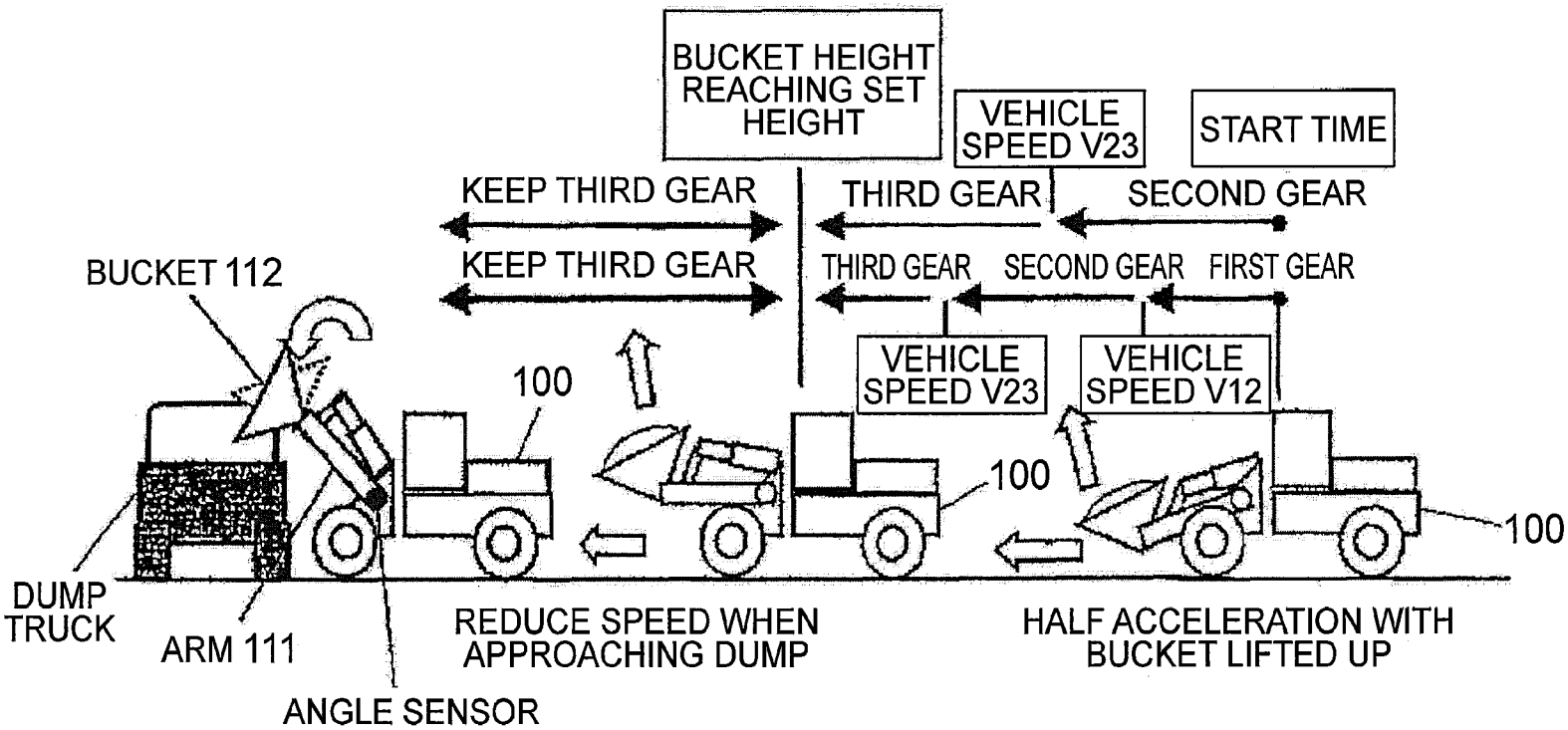
FIG. 10 A view for explaining a change of a speed stage in a transmission during loading operation of soil etc. according to the background art.

With reference to FIG. 10, description will be made about how the speed stage of the transmission 37 changes in the background-art wheel loader 1 during the work of loading soil etc. on the dump truck. To load soil etc. on the dump truck, the wheel loader 1 is moved forward toward the dump truck while lifting up the bucket 13. The speed stage is in the first gear or the second gear at the beginning (start time) of the forward movement toward the dump truck. When the engine speed of the engine 36 is low with a small amount of depression on the accelerator pedal 61, the gear shift permission vehicle speed v23 decreases as described above. As a result, the vehicle speed reaches the gear shift permission vehicle speed v23 to shift up the speed stage from the second gear to the third gear before the bucket 13 moves up to the height required for loading on the dump truck.

Since the vehicle speed increases further due to the shift-up, there is a fear that the wheel loader 1 may arrive at the dump truck before the bucket 13 moves up to the height required for loading on the dump truck. In this case, the operator of the wheel loader 1 must brake and stop the wheel loader 1 and lift up the bucket 13. Thus, this leads not only to deterioration in work efficiency but also to troublesomeness given to the operator of the wheel loader 1.

In the background art, there has been also known a transmission device having a configuration in which when the height of the bucket 13 reaches a set height or higher, a speed stage at that time is retained. However, even when the transmission device is used in the wheel loader 1, the aforementioned problem cannot be solved if the vehicle speed reaches the gear shift permission vehicle speed v23 to shift up the speed stage from the second gear to the third gear before the bucket 13 reaches the set height, as shown in FIG. 10. On the other hand, when the set height is set at a low value, there arises another problem that a speed stage which is not intended by the operator may be retained during the excavation work or the high-speed hauling work where the bucket 13 is set in a low height position.

Figure 11:
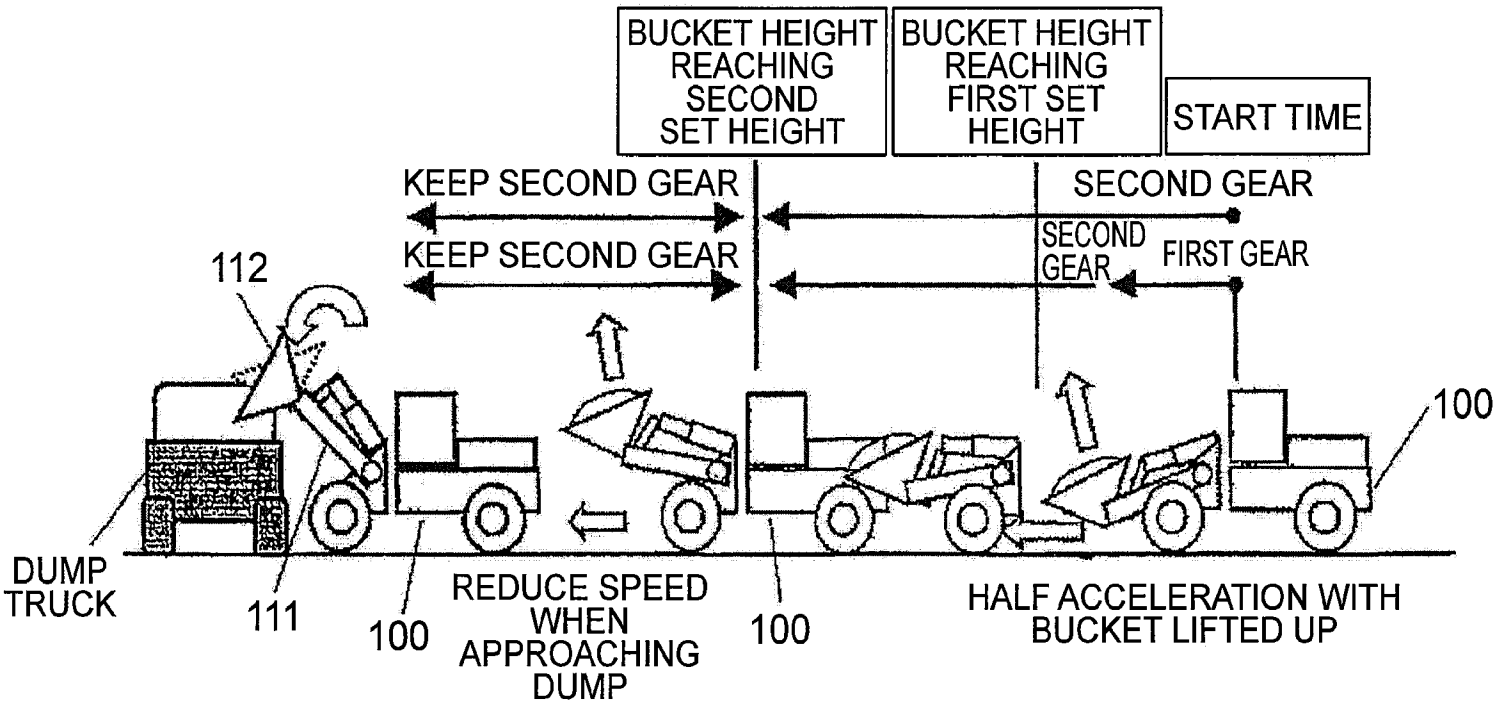
FIG. 11 A view for explaining a change of a speed stage in a transmission during loading operation of soil etc. according to the present invention.

On the other hand, in the wheel loader 1 according to the Example, the speed stage of the transmission 37 changes at the time of loading soil etc. on the dump truck as shown in FIG. 11. In the wheel loader 1 according to the Example, first, it is assumed that the gear shift permission speeds v23 and v34 are increased to the gear shift permission speeds v23*a* and v34*a* as shown in FIG. 8 when the height of the bucket 13 exceeds the first set height. In addition, shift-up from the second gear to the third gear and from the third gear to the fourth gear is forbidden when the height of the bucket 13 exceeds the second set height.

The first set height, that is, the height position of the bucket 13 during the hauling work is generally set in a position which is slightly higher than the height position of the bucket 13 during the excavation work, as described above. Therefore, when the wheel loader 1 begins to lift up the bucket 13 while moving forward toward the dump truck, the bucket 13 reaches the first set height quickly. When the height of the bucket 13 exceeds the first set height, the gear shift permission speed v23 is increased to v23*a*. Thus, the timing of shifting up from the second gear to the third gear is delayed in comparison with that in the background-art wheel loader 1. It is therefore possible to suppress the rising of the vehicle speed caused by the shift-up. That is, as soon as the wheel loader 1 begins to move forward toward the dump truck, the timing of shifting up from the second gear to the third gear can be delayed in comparison with that in the background-art wheel loader 1. On the other hand, shifting up from the second gear to the third gear is forbidden when the height of the bucket 13 exceeds the second set height. Accordingly, it is possible to prevent the problem that the wheel loader 1 may arrive at the dump truck due to acceleration caused by shift-up before the bucket 13 moves up to the height required for loading on the dump truck.

Figure 12:
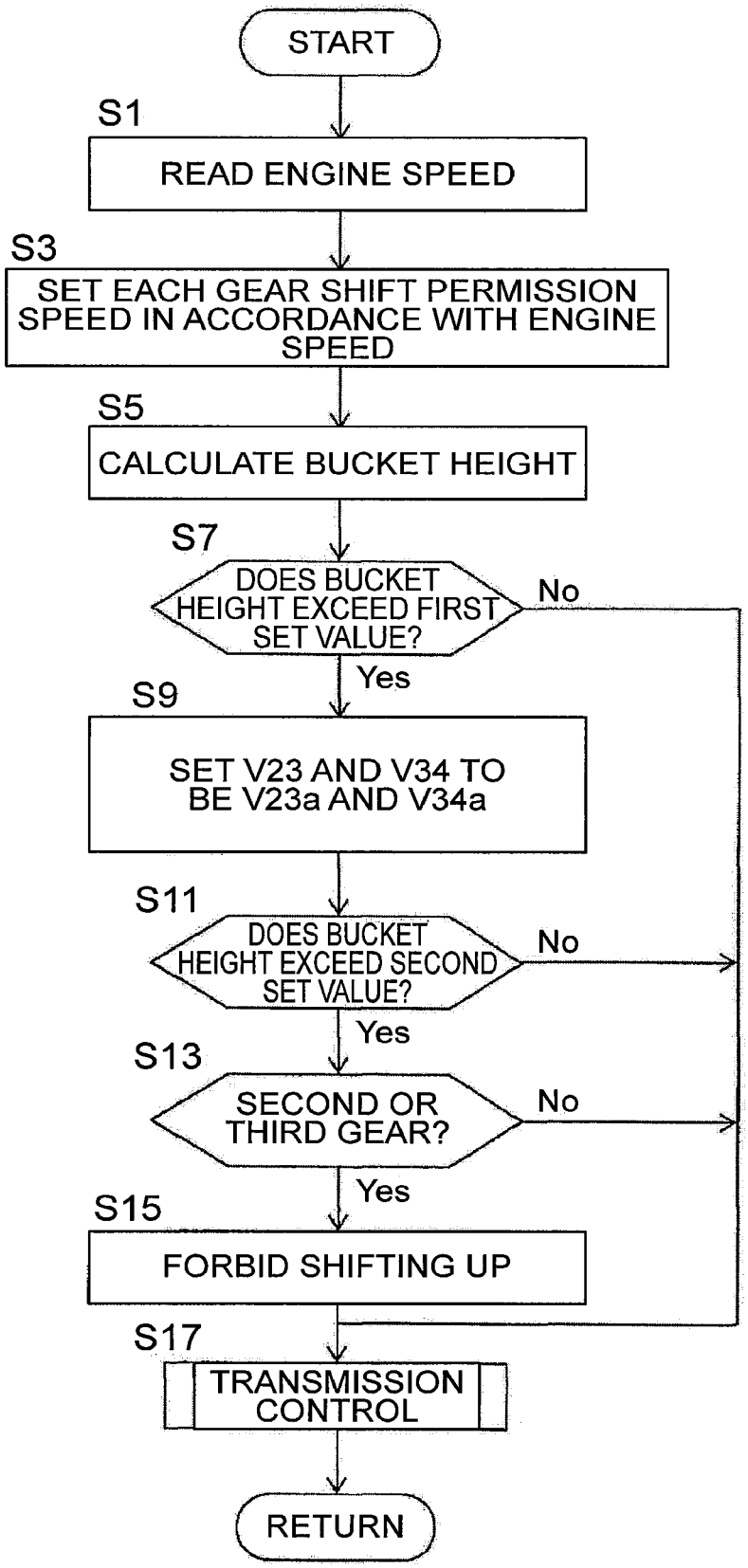
FIG. 12 A flow chart showing a transmission control process of a transmission according to Example 2.

FIG. 12 is a flow chart showing the operation of a transmission control process of the transmission 37 in the wheel loader 1 according to the embodiment. When the ignition switch of the wheel loader 1 is turned on, a program for carrying out the process shown in FIG. 12 is started up and executed repeatedly in the main controller 35. In Step S1, the engine speed of the engine 36 detected by the engine speed sensor 53 is read, and the routine of processing advances to Step S3. In Step S3, each gear shift permission speed is changed and set as shown in FIG. 8 in accordance with the engine speed of the engine 36 read in Step S1, and the routine of processing advances to Step S5.

In Step S5, the height of the bucket 13 is calculated based on the detection value of the angle sensor 40, and the routine of processing advances to Step S7. In Step S7, it is determined whether the height of the bucket 13 calculated in Step S5 exceeds the first set height (more strictly, the excavation position H1+the hauling position H2) or not. When the conclusion in Step S7 is Yes, the routine of processing advances to Step S9, in which the gear shift permission speeds v23 and v34 are changed to and set at the aforementioned gear shift permission speeds v23*a* and v34*a*, and the routine of processing advances to Step S11. In Step S11, it is determined whether the height of the bucket 13 calculated in Step S5 exceeds the second set height (more strictly, the excavation position H1+the loading position H3) or not. When the conclusion in Step S11 is Yes, the routine of processing advances to Step S13, in which it is determined whether the current speed stage selected in the transmission 37 is in the second or third gear or not, based on information about the selected state of the speed stage outputted from the transmission control device 56.

When the conclusion in Step S13 is Yes, that is, when the speed stage of the transmission 37 is in the second or third gear, forbiddance of shifting up is set, and the routine of processing advances to Step S17. In Step S17, a well-known transmission control operation is carried out based on each gear shift permission speed set in Step S3, and a control signal indicating shift-up or shift-down is outputted to the transmission control device 56 in accordance with the necessity of gear shift. Then, the routine of processing returns. Incidentally, in Step S17, when Step S9 has been executed, a transmission control operation on which a result of the execution of Step S9 is reflected is carried out. As a result, as described above, the gear is hardly shifted up from the second gear to the third gear or from the third gear to the fourth gear. In addition, in Step S17, when Step S15 has been executed, a transmission control operation on which a result of the execution of Step S15 is reflected is carried out. As a result, shifting up from the second gear to the third gear and from the third gear to the fourth gear is forbidden.

When the conclusion in any one of Steps S7, S11 and S13 is No, the routine of processing advances to Step S17.

In this manner, in the work vehicle according to Example 2, the preference or habit of the operator can be reflected on the height position of the bucket 13 during the hauling work involved in the delay of shift-up by the transmission control device 56 and the height position of the bucket 13 during the loading work involved in the forbiddance of shift-up by the transmission control device 56. Accordingly, the delay of shift-up or the forbiddance of shift-up can be prevented from being cancelled in a state which is not intended by the operator. It is therefore possible to improve the operability, the travel stability and the work efficiency of the wheel loader 1.

INDUSTRIAL APPLICABILITY

The present invention can be used for improvement in operability and travel stability in work vehicles such as a wheel loader and a fork lift.

REFERENCE SIGNS LIST

1 wheel loader
2 cab
3 rear vehicle body
4,10,12,14,15,17,20,21 connection pin
5 front vehicle body
6 rear wheel
7 front wheel
8 front work machine
9 travel vibration suppression device
11 arm
13 bucket (work tool)
16 lift cylinder
16*a* rod-side chamber
16*b* bottom-side chamber
18 bell crank
19 link member
22 bucket tilting cylinder
31 hydraulic pressure accumulator
32 control valve
33 ride control portion
34 hydraulic circuit
35 main controller
36 engine
37 transmission
38 engine controller
39 ride control switch
40 angle sensor
41 monitor unit
42 indicator
43 hydraulic oil tank
44 electromagnetic pilot valve
45 pilot pump
46 signal import switch
47 torque converter
51 propeller shaft
52 axle
53 engine speed sensor
54 directional control valve
55 control lever
56 transmission control device
57 hydraulic pump for working
61 accelerator pedal
62 pedal operation amount detector
63 rotation number detector
64 rotation number detector
65 vehicle speed detector
67 forward/backward movement changeover switch
68 shift switch
70 manual/automatic transmission changeover unit

The invention claimed is:

1. A wheel loader, comprising:

a bucket that is moved upward and downward within a predetermined range of movement by driving a lift cylinder;

a sensor that detects a height position of the bucket;

a hydraulic pressure accumulator separately provided for the lift cylinder that absorbs variation in a bottom chamber of the lift cylinder;

a control valve that changes over hydraulic oil in the bottom chamber of the lift cylinder so as to flow into or to block from the hydraulic pressure accumulator;

a controller that controls the control valve;

a signal import switch that imports a detection signal of the sensor to the controller, wherein the controller stores a detection value of the sensor as an excavation position in case the signal import switch is operated, stores a hauling position located above the excavation position by adding a first offset value to the excavation position, stores a loading position that is located above the hauling position by adding a second offset value to the excavating position, and performs a control of the control valve to permit the hydraulic oil to circulate between the bottom chamber of the lift cylinder and the hydraulic pressure accumulator, when the height position of the bucket detected by the sensor is higher than a height adding the hauling position to the excavation position and lower than a height adding the loading position to the excavation position, and a control of the control valve to not permit the hydraulic oil to circulate between the bottom chamber of the lift cylinder and the hydraulic pressure accumulator, when the height position of the bucket detected by the sensor is lower than a height adding the hauling position to the excavation positon or higher than a height adding the loading position to the excavation position.

2. The wheel loader according to claim 1, wherein the excavation position is set within a range higher than a lower limit position of the height position of the bucket and lower than the hauling position of the bucket.

3. The wheel loader according to claim 1, wherein the loading position is set within a range in which the height position of the bucket is higher than the hauling position and lower than a higher limit position of the bucket.

* * * * *